US007854771B2

(12) United States Patent
Boutique et al.

(10) Patent No.: US 7,854,771 B2
(45) Date of Patent: Dec. 21, 2010

(54) LAUNDRY DETERGENT COMPOSITION COMPRISING GLYCOSYL HYDROLASE

(75) Inventors: Jean-Pol Boutique, Gembloux (BE); Nathalie Jean Marie-Louise Vanwyngaerden, Leuven (BE); Frederik Vandenberghe, Gentbrugge (BE); Phillip Frank Souter, Morpeth (GB); Neil Joseph Lant, Newcastle upon Tyne (GB); Eugene Steven Sadlowski, Cincinnati, OH (US); Genevieve Cagalawan Wenning, Villa Hills, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 71 days.

(21) Appl. No.: 12/341,644

(22) Filed: Dec. 22, 2008

(65) Prior Publication Data

US 2009/0176682 A1 Jul. 9, 2009

Related U.S. Application Data

(60) Provisional application No. 61/010,109, filed on Jan. 4, 2008, provisional application No. 61/114,614, filed on Nov. 14, 2008.

(51) Int. Cl.

| | |
|---|---|
| ***B08B 3/04*** | (2006.01) |
| ***C11D 1/00*** | (2006.01) |
| ***C11D 3/37*** | (2006.01) |
| ***C11D 3/386*** | (2006.01) |

(52) U.S. Cl. ..... 8/137; 510/392; 510/473; 510/475; 510/530

(58) Field of Classification Search ..... 510/392, 510/473, 475, 530; 8/137
See application file for complete search history.

(56) References Cited

U.S. PATENT DOCUMENTS

| | | | | |
|---|---|---|---|---|
| 4,561,991 | A | 12/1985 | Herbots et al. | |
| 4,963,655 | A | 10/1990 | Kinder et al. | |
| 5,159,060 | A | 10/1992 | Kinder et al. | |
| 5,354,491 | A | 10/1994 | Bjorkquist et al. | |
| 5,431,842 | A | 7/1995 | Panandiker et al. | |
| 5,442,100 | A | 8/1995 | Bjorkquist et al. | |
| 5,472,628 | A | 12/1995 | Panandiker et al. | |
| 5,488,157 | A | 1/1996 | Bjorkquist et al. | |
| 5,576,282 | A | 11/1996 | Miracle et al. | |
| 5,580,486 | A | 12/1996 | Labeque et al. | |
| 5,834,415 | A | 11/1998 | Nielsen et al. | |
| 6,165,966 | A | 12/2000 | McIver et al. | |
| 6,268,197 | B1 | 7/2001 | Schulein et al. | |
| 6,306,812 | B1 | 10/2001 | Perkins et al. | |
| 6,326,348 | B1 | 12/2001 | Vinson et al. | |
| 6,440,911 | B1 | 8/2002 | Bettiol et al. | |
| 6,472,359 | B1 | 10/2002 | Ghosh | |
| 6,486,112 | B1 | 11/2002 | Bettiol et al. | |
| 6,489,279 | B2 | 12/2002 | Convents et al. | |
| 6,710,023 | B1 | 3/2004 | Bodet et al. | |
| 7,172,891 | B2 | 2/2007 | Rey et al. | |
| 7,361,736 | B2 | 4/2008 | Schnorr et al. | |
| 2003/0022807 | A1 | 1/2003 | Wilting et al. | |
| 2004/0266642 | A1 * | 12/2004 | Schnorr et al. | 510/320 |
| 2007/0281879 | A1 | 12/2007 | Sharma et al. | |
| 2008/0139442 | A1 | 6/2008 | Lang | |
| 2008/0153983 | A1 | 6/2008 | Boeckh et al. | |
| 2009/0036641 | A1 | 2/2009 | Lang et al. | |

FOREIGN PATENT DOCUMENTS

| | | | |
|---|---|---|---|
| WO | WO 92/19707 | A1 | 11/1992 |
| WO | WO 00/42146 | A1 | 7/2000 |
| WO | WO 00/42157 | A1 | 7/2000 |
| WO | WO 02/077242 | A2 | 10/2002 |
| WO | WO 2006/113314 | A1 | 10/2006 |
| WO | WO 2007/138054 | A1 | 12/2007 |
| WO | WO 2008/110318 | A2 | 9/2008 |

OTHER PUBLICATIONS

Henrissat, Bernard, A Classification of Glycosyl Hydrolases Based on Amino Acid Sequence Similarities, Biochem. J., 1991, pp. 309-316, vol. 280.

Needleman, Saul B., et al., A General Method Applicable to the Search for Similarities in the Amino Acid Sequence of Two Proteins, J. Mol. Biol., 1970, pp. 443-453, vol. 48.

Rice, Peter, et al., EMBOSS: The European Molecular Biology Open Software Suite, Jun. 2000, pp. 276-277, vol. 16, No. 6.

International Search Report, International Application No. PCT/IB2008/055468, date of mailing May 19, 2009, 4 pages.

* cited by examiner

*Primary Examiner*—Brian P Mruk
(74) *Attorney, Agent, or Firm*—James F. McBride; Armina E. Matthews; Leonard W. Lewis

(57) ABSTRACT

The present invention relates to a laundry detergent composition comprising glycosyl hydrolase. The compositions of the present invention also comprises a polymer that, when used in combination with the glycosyl hydrolase, enables compaction of the surfactant system to be achieved without loss in fabric cleaning performance. Preferably, the composition of the present invention comprises a combination of two polymers, a glycosyl hydrolase and detersive surfactant, preferably low levels of detersive surfactant.

18 Claims, No Drawings

LAUNDRY DETERGENT COMPOSITION COMPRISING GLYCOSYL HYDROLASE

CROSS REFERENCE TO RELATED APPLICATIONS

This application claims the benefit of U.S. Provisional Application No. 61/010,109 filed 4 Jan. 2008; and U.S. Provisional Application No. 61/114,614 filed 14 Nov. 2008.

FIELD OF THE INVENTION

The present invention relates to a laundry detergent composition comprising glycosyl hydrolase. The compositions of the present invention also comprises a polymer that, when used in combination with the glycosyl hydrolase, enables compaction of the surfactant system to be achieved without loss in fabric cleaning performance. Preferably, the composition of the present invention comprises a combination of two polymers, a glycosyl hydrolase and detersive surfactant, preferably low levels of detersive surfactant.

Most preferably, the laundry detergent composition of the present invention comprise: (i) a glycosyl hydrolase having enzymatic activity towards both xyloglucan and amorphous cellulose substrates, wherein the glycosyl hydrolase is selected from GH families 5, 12, 44 or 74; (ii) detersive surfactant; (iii) amphiphilic alkoxylated grease cleaning polymer; (iv) a random graft co-polymer comprising: (a) hydrophilic backbone comprising monomers selected from the group consisting of: unsaturated $C_1$-$C_6$ carboxylic acids, ethers, alcohols, aldehydes, ketones, esters, sugar units, alkoxy units, maleic anhydride, saturated polyalcohols such as glycerol, and mixtures thereof; and (b) hydrophobic side chain(s) selected from the group consisting of: $C_4$-$C_{25}$ alkyl group, polypropylene, polybutylene, vinyl ester of a saturated $C_1$-$C_6$ mono-carboxylic acid, $C_1$-$C_6$ alkyl ester of acrylic or methacrylic acid, and mixtures thereof; and (v) a compound having the following general structure: bis($(C_2H_5O)(C_2H_4O)$n)$(CH_3)$—$N^+$—$C_xH_{2x}$—$N^+$—$(CH_3)$-bis($(C_2H_5O)(C_2H_4O)$n), wherein n=from 20 to 30, and x=from 3 to 8, or sulphated or sulphonated variants thereof. Most preferably the composition is in the form of a liquid.

BACKGROUND OF THE INVENTION

Detergent manufacturers incorporate enzymes into their laundry detergent products to improve their performance. Examples of such laundry detergent compositions are described in WO98/50513, WO99/09126, WO99/09127, WO00/42157, WO00/42146 and WO01/62885.

Enzymes, being a catalytic detergent ingredient, are preferably incorporated into laundry detergent products to replace existing non-catalytic detergent ingredients. Detergent manufactures seek to formulate their laundry detergent products such that the optimal performance of enzymatic activity is achieved and that allows the reduction in the levels of other detergent ingredients and compaction of the laundry detergent product. Prior to the present invention, there was a long felt need for catalytic technologies, and especially enzymatic systems, that enable the compaction of the surfactant levels, especially in liquid laundry detergent compositions. Such compacted liquid laundry products exhibit improved environmental profiles, improved efficiency in manufacture, transport and shelf storage.

The inventors have found that the incorporation of certain glycosyl hydrolases into laundry detergent compositions, especially liquid laundry detergent compositions, that additionally comprise a specific polymer system enables the laundry detergent manufacturer to reduce the detersive surfactant levels in the laundry detergent composition. These glycosyl hydrolases have enzymatic activity towards both xyloglucan and amorphous cellulose substrates. In addition, these glycosyl hydrolases are selected from GH families 5, 12, 44 or 74. The glycosyl hydrolase (GH) family definition is described in more detail in Biochem J. 1991, v280, 309-316.

Without wishing to be bound by theory, the Inventors believe that the broad substrate specificity of these glycosyl hydrolases provides multiple benefits during the laundering process. The Inventors believe that the specific polymer system exhibits a soil remove and soil suspension profile such that improves the access of certain glycosyl hydrolases to the fabric surface. In addition, the Inventors believe the specific polymer system improves the stability of certain glycosyl hydrolases.

The Inventors believe that these certain glycosyl hydrolases biopolish the fabric surface of key soil binding sites such as amorphous cellulose and residual xyloglucan, leading to a more open fibre pore structure. It is believed that this mechanism provides good cotton soil removal, cotton soil release and whiteness maintenance performance. It is believed that this effect on fibre morphology improves the optical effects of brighteners and hueing technology, when present in the laundry detergent composition. The multiple activities of these enzymes towards cellulose and xyloglucan may also contribute to the robustness of overall soil release/removal benefits achieved compared to conventional enzymes having only cellulase activity.

The Inventors have observed significant improvement in the cotton soil release profile, whiteness maintenance profile and dingy cleaning performance of these glycosyl hydrolases when they are formulated in combination with a specific polymer system. Furthermore, these glycosyl hydrolases exhibit good stability profiles in liquid laundry detergent compositions when formulated in combination with the specific polymer system. The specific polymer system is described in more detail below but preferably the polymer system is at least a dual polymer system comprising two polymers, and is even more preferably at least a ternary polymer system comprising three polymers.

SUMMARY OF THE INVENTION

The present invention relates to laundry detergent compositions and a method for laundering fabrics therewith as defined in the claims.

DETAILED DESCRIPTION OF THE INVENTION

Laundry Detergent Composition

The laundry detergent composition of the present invention comprises: (i) a glycosyl hydrolase having enzymatic activity towards both xyloglucan and amorphous cellulose substrates, wherein the glycosyl hydrolase is selected from GH families 5, 12, 44 or 74; (ii) specific amphiphilic alkoxylated grease cleaning polymer; and (iii) detersive surfactant, preferably low levels of detersive surfactant. The glysosyl hydrolase is described in more detail below. The specific amphilic alkoxylated grease cleaning polymer is described in more detail below. The detersive surfactant is described in more detail below. Preferably, the composition comprises a compound having the following general structure: bis($(C_2H_5O)(C_2H_4O)$n)$(CH_3)$—$N^+$—$C_xH_{2x}$—$N^+$—$(CH_3)$-bis($(C_2H_5O)(C_2H_4O)$ n), wherein n=from 20 to 30, and x=from 3 to 8, or sulphated or sulphonated variants thereof.

The laundry detergent composition can be in any form, such as a solid, liquid, gel or any combination thereof. The composition may be in the form of a tablet or pouch, including multi-compartment pouches. The composition can be in the form of a free-flowing powder, such as an agglomerate, spray-dried powder, encapsulate, extrudate, needle, noodle, flake, or any combination thereof. However, the composition is preferably in the form of a liquid. Additionally, the composition is in either isotropic or anisotropic form. Preferably, the composition, or at least part thereof, is in a lamellar phase.

The composition preferably comprises low levels of water, such as from 0.01 wt % to 5 wt %, preferably to 4 wt %, or to 3 wt %, or to 2 wt %, or even to 1 wt %. This is especially preferred if the composition is in the form of a pouch, typically being at least partially, preferably completely enclosed by a water-soluble film. The water-soluble film preferably comprises polyvinyl alcohol.

The composition may comprise a structurant, such as a hydrogenated castor oil. One suitable type of structuring agent which is especially useful in the compositions of the present invention comprises non-polymeric (except for conventional alkoxylation) crystalline hydroxy-functional materials. These structurant materials typically form an associated inter-molecular thread-like network throughout the liquid matrix, typically being crystallized within the matrix in situ. Preferred structurants are crystalline, hydroxyl-containing fatty acids, fatty esters or fatty waxes. Suitable structurants will typically be selected from those having the following formula:

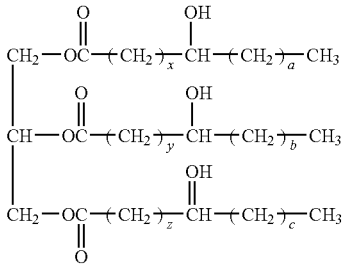

wherein:

(x+a) is from between 11 and 17;

(y+b) is from between 11 and 17; and (z+c) is from between 11 and 17.

Preferably in this formula x=y=z=10 and/or a=b=c=5.

Specific examples of preferred crystalline, hydroxyl-containing structurants include castor oil and its derivatives. Especially preferred are hydrogenated castor oil derivatives such as hydrogenated castor oil and hydrogenated castor wax. Commercially available, castor oil-based, crystalline, hydroxyl-containing structurants include THIXCIN from Rheox, Inc. (now Elementis).

The composition also preferably comprises alkanolamine to neutralize acidic components. Examples of suitable alkanolamines are triethanolamine and monoethanolamine. This is especially preferred when the composition comprises protease stabilizers such as boric acid or derivatives thereof such as boronic acid. Examples of suitable boronic acid derivatives are phenyl boronic acid derivatives of the following formula:

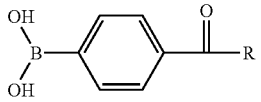

wherein R is selected from the group consisting of hydrogen, hydroxy, $C_1$-$C_6$ alkyl, substituted $C_1$-$C_6$ alkyl, $C_1$-$C_6$ alkenyl and substituted $C_1$-$C_6$ alkenyl.

A highly preferred protease stabilizer is 4-formyl-phenylboronic acid. Further suitable boronic acid derivatives suitable as protease stabilizers are described in U.S. Pat. No. 4,963,655, U.S. Pat. No. 5,159,060, WO 95/12655, WO 95/29223, WO 92/19707, WO 94/04653, WO 94/04654, U.S. Pat. No. 5,442,100, U.S. Pat. No. 5,488,157 and U.S. Pat. No. 5,472,628.

The composition may comprise a reversible peptide protease inhibitor. Preferably, the reversible peptide protease inhibitor is a tripeptide enzyme inhibitor. Illustrative non-limiting examples of suitable tripeptide enzyme inhibitor include:

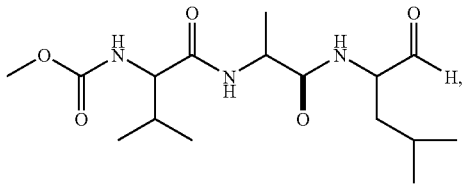

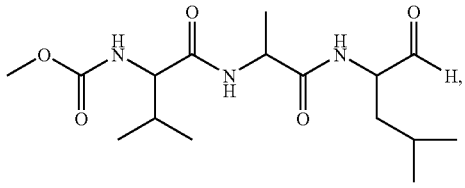

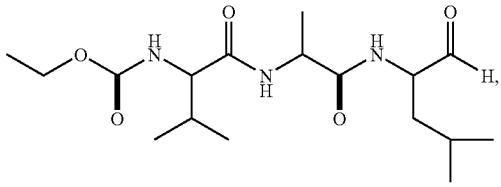

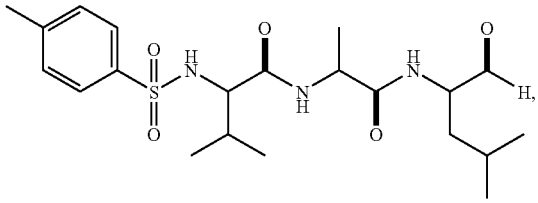

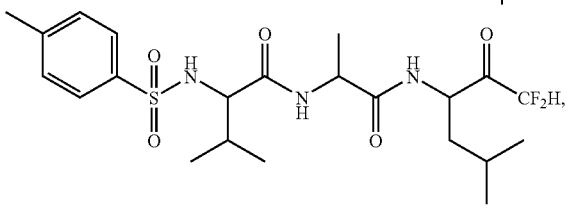

-continued

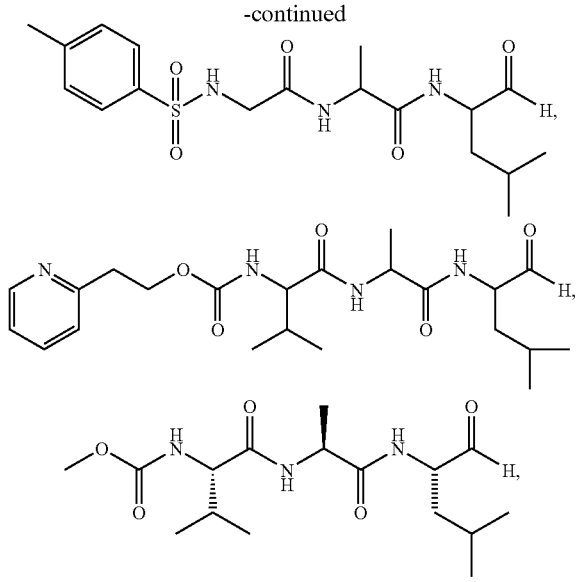

and mixtures thereof.

The reversible peptide protease inhibitor may be made in any suitable manner. Illustrative non-limiting examples of suitable processes for the manufacture of the reversible peptide protease inhibitor may be found in U.S. Pat. No. 6,165,966.

In one embodiment, the composition comprises from about 0.00001% to about 5%, specifically from about 0.00001% to about 3%, more specifically from about 0.00001% to about 1%, by weight of the composition, of the reversible peptide protease inhibitor.

The composition preferably comprises a solvent. The solvent is typically water or an organic solvent or a mixture thereof. Preferably, the solvent is a mixture of water and an organic solvent. If the composition is in the form of a unit dose pouch, then preferably the composition comprises an organic solvent and less than 10 wt %, or 5 wt %, or 4 wt % or 3 wt % free water, and may even be anhydrous, typically comprising no deliberately added free water. Free water is typically measured using Karl Fischer titration. 2 g of the laundry detergent composition is extracted into 50 ml dry methanol at room temperature for 20 minutes and analyse 1 ml of the methanol by Karl Fischer titration.

The composition may comprise from above 0 wt % to 8 wt %, preferably from above 0 wt % to 5 wt %, most preferably from above 0 wt % to 3 wt % organic solvent. Suitable solvents include $C_4$-$C_{14}$ ethers and diethers, glycols, alkoxylated glycols, $C_6$-$C_{16}$ glycol ethers, alkoxylated aromatic alcohols, aromatic alcohols, aliphatic branched alcohols, alkoxylated aliphatic branched alcohols, alkoxylated linear $C_1$-$C_5$ alcohols, linear $C_1$-$C_5$ alcohols, amines, $C_8$-$C_{14}$ alkyl and cycloalkyl hydrocarbons and halohydrocarbons, and mixtures thereof.

Preferred solvents are selected from methoxy octadecanol, 2-(2-ethoxyethoxy)ethanol, benzyl alcohol, 2-ethylbutanol and/or 2-methylbutanol, 1-methylpropoxyethanol and/or 2-methylbutoxyethanol, linear $C_1$-$C_5$ alcohols such as methanol, ethanol, propanol, butyl diglycol ether (BDGE), butyltriglycol ether, tert-amyl alcohol, glycerol, isopropanol and mixtures thereof. Particularly preferred solvents which can be used herein are butoxy propoxy propanol, butyl diglycol ether, benzyl alcohol, butoxypropanol, propylene glycol, glycerol, ethanol, methanol, isopropanol and mixtures thereof. Other suitable solvents include propylene glycol and diethylene glycol and mixtures thereof.

Solid Laundry Detergent Composition

In one embodiment of the present invention, the composition is a solid laundry detergent composition, preferably a solid laundry powder detergent composition.

The composition preferably comprises from 0 wt % to 10 wt %, or even to 5 wt % zeolite builder. The composition also preferably comprises from 0 wt % to 10 wt %, or even to 5 wt % phosphate builder.

The composition typically comprises anionic detersive surfactant, preferably linear alkyl benzene sulphonate, preferably in combination with a co-surfactant. Preferred co-surfactants are alkyl ethoxylated sulphates having an average degree of ethoxylation of from 1 to 10, preferably from 1 to 3, and/or ethoxylated alcohols having an average degree of ethoxylation of from 1 to 10, preferably from 3 to 7.

The composition preferably comprises chelant, preferably the composition comprises from 0.3 wt % to 2.0 wt % chelant. A suitable chelant is ethylenediamine-N,N'-disuccinic acid (EDDS).

The composition may comprise cellulose polymers, such as sodium or potassium salts of carboxymethyl cellulose, carboxyethyl cellulose, sulfoethyl cellulose, sulfopropyl cellulose, cellulose sulfate, phosphorylated cellulose, carboxymethyl hydroxyethyl cellulose, carboxymethyl hydroxypropyl cellulose, sulfoethyl hydroxyethyl cellulose, sulfoethyl hydroxypropyl cellulose, carboxymethyl methyl hydroxyethyl cellulose, carboxymethyl methyl cellulose, sulfoethyl methyl hydroxyethyl cellulose, sulfoethyl methyl cellulose, carboxymethyl ethyl hydroxyethyl cellulose, carboxymethyl ethyl cellulose, sulfoethyl ethyl hydroxyethyl cellulose, sulfoethyl ethyl cellulose, carboxymethyl methyl hydroxypropyl cellulose, sulfoethyl methyl hydroxypropyl cellulose, carboxymethyl dodecyl cellulose, carboxymethyl dodecoyl cellulose, carboxymethyl cyanoethyl cellulose, and sulfoethyl cyanoethyl cellulose. The cellulose may be a substituted cellulose substituted by two or more different substituents, such as methyl and hydroxyethyl cellulose.

The composition may comprise soil release polymers, such as Repel-o-Tex™. Other suitable soil release polymers are anionic soil release polymers. Suitable soil release polymers are described in more detail in WO05123835A1, WO07079850A1 and WO08110318A2.

The composition may comprise a spray-dried powder. The spray-dried powder may comprise a silicate salt, such as sodium silicate.

Glycosyl Hydrolase

The glycosyl hydrolase has enzymatic activity towards both xyloglucan and amorphous cellulose substrates, wherein the glycosyl hydrolase is selected from GH families 5, 12, 44 or 74.

The enzymatic activity towards xyloglucan substrates is described in more detail below. The enzymatic activity towards amorphous cellulose substrates is described in more detail below.

The glycosyl hydrolase enzyme preferably belongs to glycosyl hydrolase family 44. The glycosyl hydrolase (GH) family definition is described in more detail in Biochem J. 1991, v280, 309-316.

The glycosyl hydrolase enzyme preferably has a sequence at least 70%, or at least 75% or at least 80%, or at least 85%, or at least 90%, or at least 95% identical to sequence ID No. 1.

For purposes of the present invention, the degree of identity between two amino acid sequences is determined using the Needleman-Wunsch algorithrn (Needleman and Wunsch, 1970, *J. Mol. Biol.* 48: 443-453) as implemented in the Needle program of the EMBOSS package (EMBOSS: The European Molecular Biology Open Software Suite, Rice et al., 2000, *Trends in Genetics* 16: 276-277), preferably version 3.0.0 or later. The optional parameters used are gap open penalty of 10, gap extension penalty of 0.5, and the EBLOSUM62 (EMBOSS version of BLOSUM62) substitution matrix. The output of Needle labeled "longest identity" (obtained using the—nobrief option) is used as the percent identity and is calculated as follows: (Identical Residues×100)/(Length of Alignment−Total Number of Gaps in Alignment).

Suitable glycosyl hydrolases are selected from the group consisting of: GH family 44 glycosyl hydrolases from *Paenibacillus polyxyma* (wild-type) such as XYG1006 described in WO 01/062903 or are variants thereof; GH family 12 glycosyl hydrolases from *Bacillus licheniformis* (wild-type) such as Seq. No. ID: 1 described in WO 99/02663 or are variants thereof; GH family 5 glycosyl hydrolases from *Bacillus agaradhaerens* (wild type) or variants thereof; GH family 5 glycosyl hydrolases from *Paenibacillus* (wild type) such as XYG1034 and XYG 1022 described in WO 01/064853 or variants thereof; GH family 74 glycosyl hydrolases from *Jonesia* sp. (wild type) such as XYG1020 described in WO 2002/077242 or variants thereof, and GH family 74 glycosyl hydrolases from *Trichoderma Reesei* (wild type), such as the enzyme described in more detail in Sequence ID no. 2 of WO03/089598, or variants thereof.

Preferred glycosyl hydrolases are selected from the group consisting of: GH family 44 glycosyl hydrolases from *Paenibacillus polyxyma* (wild-type) such as XYG1006 or are variants thereof.

Enzymatic Activity Towards Xyloglucan Substrates

An enzyme is deemed to have activity towards xyloglucan if the pure enzyme has a specific activity of greater than 50000 XyloU/g according to the following assay at pH 7.5.

The xyloglucanase activity is measured using AZCL-xyloglucan from Megazyme, Ireland as substrate (blue substrate).

A solution of 0.2% of the blue substrate is suspended in a 0.1M phosphate buffer pH 7.5, 20° C. under stirring in a 1.5 ml Eppendorf tubes (0.75 ml to each), 50 microlitres enzyme solution is added and they are incubated in an Eppendorf Thermomixer for 20 minutes at 40° C., with a mixing of 1200 rpm. After incubation the coloured solution is separated from the solid by 4 minutes centrifugation at 14,000 rpm and the absorbance of the supernatant is measured at 600 nm in a 1 cm cuvette using a spectrophotometer. One XyloU unit is defined as the amount of enzyme resulting in an absorbance of 0.24 in a 1 cm cuvette at 600 nm.

Only absorbance values between 0.1 and 0.8 are used to calculate the XyloU activity. If an absorbance value is measured outside this range, optimization of the starting enzyme concentration should be carried out accordingly.

Enzymatic Activity Towards Amorphous Cellulose Substrates

An enzyme is deemed to have activity towards amorphous cellulose if the pure enzyme has a specific activity of greater than 20000 EBG/g according to the following assay at pH 7.5. Chemicals used as buffers and substrates were commercial products of at least reagent grade.

Endoglucanase Activity Assay Materials:

0.1M phosphate buffer pH 7.5

Cellazyme C tablets, supplied by Megazyme International, Ireland.

Glass microfiber filters, GF/C, 9 cm diameter, supplied by Whatman.

Method:

In test tubes, mix 1 ml pH 7.5 buffer and 5 ml deionised water.

Add 100 microliter of the enzyme sample (or of dilutions of the enzyme sample with known weight:weight dilution factor). Add 1 Cellazyme C tablet into each tube, cap the tubes and mix on a vortex mixer for 10 seconds. Place the tubes in a thermostated water bath, temperature 40° C. After 15, 30 and 45 minutes, mix the contents of the tubes by inverting the tubes, and replace in the water bath. After 60 minutes, mix the contents of the tubes by inversion and then filter through a GF/C filter. Collect the filtrate in a clean tube.

Measure Absorbance (Aenz) at 590 nm, with a spectrophotometer. A blank value, Awater, is determined by adding 100 μl water instead of 100 microliter enzyme dilution.

Calculate Adelta=Aenz−Awater.

Adelta must be <0.5. If higher results are obtained, repeat with a different enzyme dilution factor.

Determine DFO.1, where DFO.1 is the dilution factor needed to give Adelta=0.1.

Unit Definition: 1 Endo-Beta-Glucanase activity unit (1 EBG) is the amount of enzyme that gives Adelta=0.10, under the assay conditions specified above. Thus, for example, if a given enzyme sample, after dilution by a dilution factor of 100, gives Adelta=0.10, then the enzyme sample has an activity of 100 EBG/g.

Amphiphilic Alkoxylated Grease Cleaning Polymer

Amphiphilic alkoxylated grease cleaning polymers of the present invention refer to any alkoxylated polymers having balanced hydrophilic and hydrophobic properties such that they remove grease particles from fabrics and surfaces. Specific embodiments of the amphiphilic alkoxylated grease cleaning polymers of the present invention comprise a core structure and a plurality of alkoxylate groups attached to that core structure.

The core structure may comprise a polyalkylenimine structure comprising, in condensed form, repeating units of formulae (I), (II), (III) and (IV):

(I)

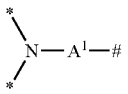

(II)

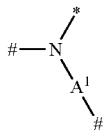

(III)

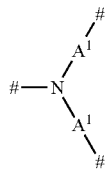

-continued (IV)

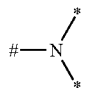

wherein # in each case denotes one-half of a bond between a nitrogen atom and the free binding position of a group $A^1$ of two adjacent repeating units of formulae (I), (II), (III) or (IV); * in each case denotes one-half of a bond to one of the alkoxylate groups; and $A^1$ is independently selected from linear or branched $C_2$-$C_6$-alkylene; wherein the polyalkylenimine structure consists of 1 repeating unit of formula (I), x repeating units of formula (II), y repeating units of formula (III) and y+1 repeating units of formula (IV), wherein x and y in each case have a value in the range of from 0 to about 150; where the average weight average molecular weight, Mw, of the polyalkylenimine core structure is a value in the range of from about 60 to about 10,000 g/mol.

The core structure may alternatively comprise a polyalkanolamine structure of the condensation products of at least one compound selected from N-(hydroxyalkyl)amines of formulae (I.a) and/or (I.b), (I.a)

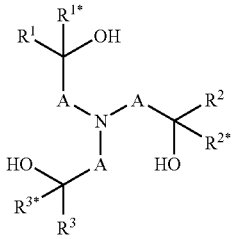

(I.b)

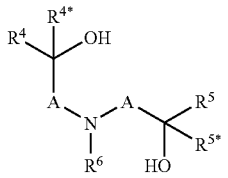

wherein A are independently selected from $C_1$-$C_6$-alkylene; $R^1$, $R^{1*}$, $R^2$, $R^{2*}$, $R^3$, $R^{3*}$, $R^4$, $R^{4*}$, $R^5$ and $R^{5*}$ are independently selected from hydrogen, alkyl, cycloalkyl or aryl, wherein the last three mentioned radicals may be optionally substituted; and $R^6$ is selected from hydrogen, alkyl, cycloalkyl or aryl, wherein the last three mentioned radicals may be optionally substituted.

The plurality of alkylenoxy groups attached to the core structure are independently selected from alkylenoxy units of the formula (V)

(V)

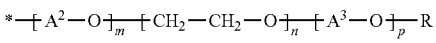

wherein * in each case denotes one-half of a bond to the nitrogen atom of the repeating unit of formula (I), (II) or (IV); $A^2$ is in each case independently selected from 1,2-propylene, 1,2-butylene and 1,2-isobutylene; $A^3$ is 1,2-propylene; R is in each case independently selected from hydrogen and $C_1$-$C_4$-alkyl; m has an average value in the range of from 0 to about 2; n has an average value in the range of from about 20 to about 50; and p has an average value in the range of from about 10 to about 50.

Specific embodiments of the amphiphilic alkoxylated grease cleaning polymers may be selected from alkoxylated polyalkylenimines having an inner polyethylene oxide block and an outer polypropylene oxide block, the degree of ethoxylation and the degree of propoxylation not going above or below specific limiting values. Specific embodiments of the alkoxylated polyalkylenimines according to the present invention have a minimum ratio of polyethylene blocks to polypropylene blocks (n/p) of about 0.6 and a maximum of about $1.5(x+2y+1)^{1/2}$. Alkoxykated polyalkyenimines having an n/p ratio of from about 0.8 to about $1.2(x+2y+1)^{1/2}$ have been found to have especially beneficial properties.

The alkoxylated polyalkylenimines according to the present invention have a backbone which consists of primary, secondary and tertiary amine nitrogen atoms which are attached to one another by alkylene radicals A and are randomly arranged. Primary amino moieties which start or terminate the main chain and the side chains of the polyalkylenimine backbone and whose remaining hydrogen atoms are subsequently replaced by alkylenoxy units are referred to as repeating units of formulae (I) or (IV), respectively. Secondary amino moieties whose remaining hydrogen atom is subsequently replaced by alkylenoxy units are referred to as repeating units of formula (II). Tertiary amino moieties which branch the main chain and the side chains are referred to as repeating units of formula (III).

Since cyclization can occur in the formation of the polyalkylenimine backbone, it is also possible for cyclic amino moieties to be present to a small extent in the backbone. Such polyalkylenimines containing cyclic amino moieties are of course alkoxylated in the same way as those consisting of the noncyclic primary and secondary amino moieties.

The polyalkylenimine backbone consisting of the nitrogen atoms and the groups $A^1$, has an average molecular weight Mw of from about 60 to about 10,000 g/mole, preferably from about 100 to about 8,000 g/mole and more preferably from about 500 to about 6,000 g/mole.

The sum (x+2y+1) corresponds to the total number of alkylenimine units present in one individual polyalkylenimine backbone and thus is directly related to the molecular weight of the polyalkylenimine backbone. The values given in the specification however relate to the number average of all polyalkylenimines present in the mixture. The sum (x+2y+2) corresponds to the total number amino groups present in one individual polyalkylenimine backbone.

The radicals $A^1$ connecting the amino nitrogen atoms may be identical or different, linear or branched $C_2$-$C_6$-alkylene radicals, such as 1,2-ethylene, 1,2-propylene, 1,2-butylene, 1,2-isobutylene, 1,2-pentanediyl, 1,2-hexanediyl or hexamethylen. A preferred branched alkylene is 1,2-propylene. Preferred linear alkylene are ethylene and hexamethylene. A more preferred alkylene is 1,2-ethylene.

The hydrogen atoms of the primary and secondary amino groups of the polyalkylenimine backbone are replaced by alkylenoxy units of the formula (V).

(V)

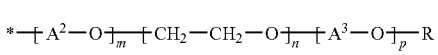

In this formula, the variables preferably have one of the meanings given below:

$A^2$ in each case is selected from 1,2-propylene, 1,2-butylene and 1,2-isobutylene; preferably $A^2$ is 1,2-propylene. $A^3$ is 1,2-propylene; R in each case is selected from hydrogen and $C_1$-$C_4$-alkyl, such as methyl, ethyl, n-propyl, isopropyl, n-butyl, isobutyl and tert.-butyl; preferably R is hydrogen. The index m in each case has a value of 0 to about 2; preferably m is 0 or approximately 1; more preferably m is 0. The index n has an average value in the range of from about 20 to about 50, preferably in the range of from about 22 to about 40, and more preferably in the range of from about 24 to about 30. The index p has an average value in the range of from about 10 to about 50, preferably in the range of from about 11 to about 40, and more preferably in the range of from about 12 to about 30.

Preferably the alkylenoxy unit of formula (V) is a non-random sequence of alkoxylate blocks. By non-random sequence it is meant that the $[-A^2-O—]_m$ is added first (i.e., closest to the bond to the nitrgen atom of the repeating unit of formula (I), (II), or (III)), the $[—CH_2—CH_2—O—]_n$ is added second, and the $[-A^3-O—]_p$ is added third. This orientation provides the alkoxylated polyalkylenimine with an inner polyethylene oxide block and an outer polypropylene oxide block.

The substantial part of these alkylenoxy units of formula (V) is formed by the ethylenoxy units $—[CH_2—CH_2—O)]_n—$ and the propylenoxy units $—[CH_2—CH_2(CH_3)—O]_p—$. The alkylenoxy units may additionally also have a small proportion of propylenoxy or butylenoxy units $-[A^2-O]_m—$, i.e. the polyalkylenimine backbone saturated with hydrogen atoms may be reacted initially with small amounts of up to about 2 mol, especially from about 0.5 to about 1.5 mol, in particular from about 0.8 to about 1.2 mol, of propylene oxide or butylene oxide per mole of NH— moieties present, i.e. incipiently alkoxylated.

This initial modification of the polyalkylenimine backbone allows, if necessary, the viscosity of the reaction mixture in the alkoxylation to be lowered. However, the modification generally does not influence the performance properties of the alkoxylated polyalkylenimine and therefore does not constitute a preferred measure.

The amphiphilic alkoxylated grease cleaning polymers are present in the detergent and cleaning compositions of the present invention at levels ranging from about 0.05% to 10% by weight of the composition. Embodiments of the compositions may comprise from about 0.1% to about 5% by weight. More specifically, the embodiments may comprise from about 0.25 to about 2.5% of the grease cleaning polymer.

Detersive Surfactant

The composition comprises detersive surfactant. The detersive surfactant can be anionic, non-ionic, cationic and/or zwitterionic. Preferably, the detersive surfactant is anionic. The compositions preferably comprise from 2% to 50% surfactant, more preferably from 5% to 30%, most preferably from 7% to 20% detersive surfactant. The composition may comprise from 2% to 6% detersive surfactant. The composition preferably comprises detersive surfactant in an amount to provide from 100 ppm to 5,000 ppm detersive surfactant in the wash liquor during the laundering process. This is especially preferred when from 10 g to 125 g of liquid laundry detergent composition is dosed into the wash liquor during the laundering process. The composition upon contact with water typically forms a wash liquor comprising from 0.5 g/l to 10 g/l detergent composition.

Random Graft Co-Polymer

The random graft co-polymer comprises: (i) hydrophilic backbone comprising monomers selected from the group consisting of: unsaturated $C_1$-$C_6$ carboxylic acids, ethers, alcohols, aldehydes, ketones, esters, sugar units, alkoxy units, maleic anhydride, saturated polyalcohols such as glycerol, and mixtures thereof; and (ii) hydrophobic side chain(s) selected from the group consisting of: $C_4$-$C_{25}$ alkyl group, polypropylene, polybutylene, vinyl ester of a saturated $C_1$-$C_6$ mono-carboxylic acid, $C_1$-$C_6$ alkyl ester of acrylic or methacrylic acid, and mixtures thereof.

The polymer preferably has the general formula:

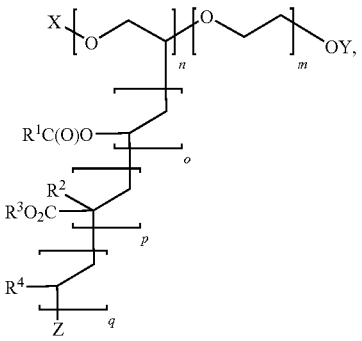

wherein X, Y and Z are capping units independently selected from H or a $C_{1-6}$ alkyl; each $R^1$ is independently selected from methyl and ethyl; each $R^2$ is independently selected from H and methyl; each $R^3$ is independently a $C_{1-4}$ alkyl; and each $R^4$ is independently selected from pyrrolidone and phenyl groups. The weight average molecular weight of the polyethylene oxide backbone is typically from about 1,000 g/mol to about 18,000 g/mol, or from about 3,000 g/mol to about 13,500 g/mol, or from about 4,000 g/mol to about 9,000 g/mol. The value of m, n, o, p and q is selected such that the pendant groups comprise, by weight of the polymer at least 50%, or from about 50% to about 98%, or from about 55% to about 95%, or from about 60% to about 90%. The polymer useful herein typically has a weight average molecular weight of from about 1,000 to about 100,000 g/mol, or preferably from about 2,500 g/mol to about 45,000 g/mol, or from about 7,500 g/mol to about 33,800 g/mol, or from about 10,000 g/mol to about 22,500 g/mol.

Suitable graft co-polymers are described in more detail in WO07/138054, WO06/108856 and WO06/113314.

Adjunct Ingredients

Suitable adjunct materials include, but are not limited to, surfactants, builders, chelating agents, dye transfer inhibiting agents, dispersants, additional enzymes, and enzyme stabilizers, catalytic materials, bleach activators, hydrogen peroxide, sources of hydrogen peroxide, preformed peracids, polymeric dispersing agents, clay soil removal/anti-redeposition agents, brighteners, suds suppressors, dyes, perfumes, structure elasticizing agents, fabric softeners, carriers, hydrotropes, processing aids, solvents and/or pigments. In addition to the disclosure below, suitable examples of such other adjuncts and levels of use are found in U.S. Pat. Nos. 5,576,282, 6,306,812 and 6,326,348.

Second Embodiment of the Present Invention

In a second embodiment of the present invention, the composition comprises:

(i) a glycosyl hydrolase having enzymatic activity towards both xyloglucan and amorphous cellulose substrates, wherein the glycosyl hydrolase is selected from GH families 5, 12, 44 or 74;

(ii) a random graft copolymer comprising: (a) hydrophilic backbone comprising monomers selected from the group consisting of: unsaturated $C_1$-$C_6$ acids, ethers, alcohols, aldehydes, ketones, esters, sugar units, alkoxy units, maleic anhydride, saturated polyalcohols such as glycerol, and mixtures thereof; and (b) hydrophobic side chain(s) selected from the group consisting of: $C_4$-$C_{25}$ alkyl group, polypropylene, polybutylene, vinyl ester of a saturated $C_1$-$C_6$ mono-carboxylic acid, $C_1$-$C_6$ alkyl ester of acrylic or methacrylic acid, and mixtures thereof, and (iii) detersive surfactant, preferably low levels of detersive surfactant. The detersive surfactant is described in more detail above. The random graft co-polymer is described in more detail above.

The composition preferably comprises amphiphilic alkoxylated grease cleaning polymer. The amphiphilic alkoxylated grease cleaning polymer is described in more detail above.

Preferably, the composition comprises a compound having the following general structure: bis($(C_2H_5O)(C_2H_4O)n$)($CH_3$)—$N^+$—$C_xH_{2x}$—$N^+$—($CH_3$)-bis($(C_2H_5O)(C_2H_4O)n$), where n=from 20 to 30, and x=from 3 to 8, or sulphated or sulphonated variants thereof.

Preferably, the composition is in the form of a liquid. Preferably, the glycosyl hydrolase enzyme has a sequence at least 70% identical to sequence ID No. 1. Preferably, the glycosyl enzyme has the amino acid sequence ID. No. 1. The glycosyl hydrolase is described in more detail above. The composition may also comprise additional adjunct components. The adjunct components are described in more detail above.

EXAMPLES

Examples 1-8

Liquid laundry detergent compositions suitable for front-loading automatic washing machines.

| | Composition (wt % of composition) | | | | | | | |
|---|---|---|---|---|---|---|---|---|
| Ingredient | 1 | 2 | 3 | 4 | 5 | 6 | 7 | 8 |
| Alkylbenzene sulfonic acid | 7 | 11 | 4.5 | 1.2 | 1.5 | 12.5 | 5.2 | 4 |
| Sodium $C_{12-14}$ alkyl ethoxy 3 sulfate | 2.3 | 3.5 | 4.5 | 4.5 | 7 | 18 | 1.8 | 2 |
| $C_{14-15}$ alkyl 8-ethoxylate | 5 | 8 | 2.5 | 2.6 | 4.5 | 4 | 3.7 | 2 |
| $C_{12}$ alkyl dimethyl amine oxide | — | — | 0.2 | — | — | — | — | — |
| $C_{12-14}$ alkyl hydroxyethyl dimethyl ammonium chloride | — | — | — | 0.5 | — | — | — | — |
| $C_{12-18}$ Fatty acid | 2.6 | 4 | 4 | 2.6 | 2.8 | 11 | 2.6 | 1.5 |
| Citric acid | 2.6 | 3 | 1.5 | 2 | 2.5 | 3.5 | 2.6 | 2 |
| Protease (Purafect ® Prime) | 0.5 | 0.7 | 0.6 | 0.3 | 0.5 | 2 | 0.5 | 0.6 |
| Amylase (Natalase ®) | 0.1 | 0.2 | 0.15 | — | 0.05 | 0.5 | 0.1 | 0.2 |
| Mannanase (Mannaway ®) | 0.05 | 0.1 | 0.05 | — | — | 0.1 | 0.04 | — |
| Xyloglucanase XYG1006* (mg aep/100 g detergent) | 1 | 4 | 3 | 3 | 2 | 8 | 2.5 | 4 |
| Random graft co-polymer[1] | 1 | 0.2 | 1 | 0.4 | 0.5 | 2.7 | 0.3 | 1 |
| A compound having the following general structure: bis($(C_2H_5O)(C_2H_4O)n$)($CH_3$)—$N^+$—$C_xH_{2x}$—$N^+$—($CH_3$)-bis($(C_2H_5O)(C_2H_4O)n$), wherein n = from 20 to 30, and x = from 3 to 8, or sulphated or sulphonated variants thereof | 0.4 | 2 | 0.4 | 0.6 | 1.5 | 1.8 | 0.7 | 0.3 |
| Ethoxylated Polyethylenimine[2] | — | — | — | — | — | 0.5 | — | — |
| Amphiphilic alkoxylated grease cleaning polymer[3] | 0.1 | 0.2 | 0.1 | 0.2 | 0.3 | 0.3 | 0.2 | 0.3 |
| Diethoxylated poly (1,2 propylene terephthalate short block soil release polymer. | — | — | — | — | — | — | 0.3 | — |
| Diethylenetriaminepenta(methylene phosphonic) acid | 0.2 | 0.3 | — | — | 0.2 | — | 0.2 | 0.3 |
| Hydroxyethane diphosphonic acid | — | — | 0.45 | — | — | 1.5 | — | 0.1 |
| FWA | 0.1 | 0.2 | 0.1 | — | — | 0.2 | 0.05 | 0.1 |
| Solvents (1,2 propanediol, ethanol), stabilizers | 3 | 4 | 1.5 | 1.5 | 2 | 4.3 | 2 | 1.5 |
| Hydrogenated castor oil derivative structurant | 0.4 | 0.4 | 0.3 | 0.1 | 0.3 | — | 0.4 | 0.5 |
| Boric acid | 1.5 | 2.5 | 2 | 1.5 | 1.5 | 0.5 | 1.5 | 1.5 |
| Na formate | — | — | — | 1 | — | — | — | — |
| Reversible protease inhibitor[4] | — | — | 0.002 | — | — | — | — | — |
| Perfume | 0.5 | 0.7 | 0.5 | 0.5 | 0.8 | 1.5 | 0.5 | 0.8 |
| Perfume MicroCapsules slurry (30% am) | 0.2 | 0.3 | 0.7 | 0.2 | 0.05 | 0.4 | 0.9 | 0.7 |
| Ethoxylated thiophene Hueing Dye | | | | | | | 0.007 | 0.008 |
| Buffers (sodium hydroxide, Monoethanolamine) | | | | To pH 8.2 | | | | |
| Water and minors (antifoam, aesthetics) | | | | To 100% | | | | |

Examples 9-16

Liquid laundry detergent compositions suitable for top-loading automatic washing machines.

| Ingredient | Composition (wt % of composition) | | | | | | | |
|---|---|---|---|---|---|---|---|---|
| | 9 | 10 | 11 | 12 | 13 | 14 | 15 | 16 |
| $C_{12-15}$ Alkylethoxy(1.8)sulfate | 20.1 | 15.1 | 20.0 | 15.1 | 13.7 | 16.7 | 10.0 | 9.9 |
| $C_{11.8}$ Alkylbenzene sulfonate | 2.7 | 2.0 | 1.0 | 2.0 | 5.5 | 5.6 | 3.0 | 3.9 |
| $C_{16-17}$ Branched alkyl sulfate | 6.5 | 4.9 | | 4.9 | 3.0 | 9.0 | 2.0 | |
| $C_{12-14}$ Alkyl-9-ethoxylate | 0.8 | 0.8 | 0.8 | 0.8 | 8.0 | 1.5 | 0.3 | 11.5 |
| $C_{12}$ dimethylamine oxide | | | 0.9 | | | | | |
| Citric acid | 3.8 | 3.8 | 3.8 | 3.8 | 3.5 | 3.5 | 2.0 | 2.1 |
| $C_{12-18}$ fatty acid | 2.0 | 1.5 | 2.0 | 1.5 | 4.5 | 2.3 | | 0.9 |
| Protease (Purafect ® Prime) | 1.5 | 1.5 | 0.5 | 1.5 | 1.0 | 1.8 | 0.5 | 0.5 |
| Amylase (Natalase ®) | 0.3 | 0.3 | 0.3 | 0.3 | 0.2 | 0.4 | | |
| Amylase (Stainzyme ®) | | | | | | | | 1.1 |
| Mannanase (Mannaway ®) | 0.1 | | | | | 0.1 | | |
| Pectate Lyase (Pectawash ®) | 0.1 | | | | | 0.2 | | |
| Xyloglucanase XYG1006* (mg aep/100 g detergent) | 5 | 13 | 2 | 5 | 20 | 1 | 2 | 3 |
| Borax | 3.0 | 3.0 | | | 2.0 | 3.0 | 3.0 | 3.3 |
| Na & Ca formate | 0.2 | 0.2 | | 0.2 | 0.2 | | 0.7 | |
| A compound having the following general structure: bis($(C_2H_5O)(C_2H_4O)n$)($CH_3$)—$N^+$—$C_xH_{2x}$—$N^+$—($CH_3$)-bis($(C_2H_5O)(C_2H_4O)n$), wherein n = from 20 to 30, and x = from 3 to 8, or sulphated or sulphonated variants thereof | 1.6 | 1.6 | 3.0 | 1.6 | 2.0 | 1.6 | 1.3 | 1.2 |
| Random graft co-polymer[1] | 0.4 | 0.2 | 1.0 | 0.5 | 0.6 | 1.0 | 0.8 | 1.0 |
| Diethylene triamine pentaacetic acid | 0.4 | 0.4 | 0.4 | 0.4 | 0.2 | 0.3 | 0.8 | |
| Tinopal AMS-GX | 0.2 | 0.2 | 0.2 | 0.2 | 0.2 | 0.3 | 0.1 | |
| Tinopal CBS-X | | | | | | 0.1 | | 0.2 |
| Amphiphilic alkoxylated grease cleaning polymer[3] | 1.0 | 1.3 | 1.3 | 1.4 | 1.0 | 1.1 | 1.0 | 1.0 |
| Texcare 240N (Clariant) | | | | 1.0 | | | | |
| Ethanol | 2.6 | 2.6 | 2.6 | 2.6 | 1.8 | 3.0 | 1.3 | |
| Propylene Glycol | 4.6 | 4.6 | 4.6 | 4.6 | 3.0 | 4.0 | 2.5 | |
| Diethylene glycol | 3.0 | 3.0 | 3.0 | 3.0 | 3.0 | 2.7 | 3.6 | |
| Polyethylene glycol | 0.2 | 0.2 | 0.2 | 0.2 | 0.1 | 0.3 | 0.1 | 1.4 |
| Monoethanolamine | 2.7 | 2.7 | 2.7 | 2.7 | 4.7 | 3.3 | 1.7 | 0.4 |
| Triethanolamine | | | | | | | | 0.9 |
| NaOH | to pH 8.3 | to pH 8.3 | to pH 8.3 | to pH 8.3 | to pH 8.3 | to pH 8.3 | to pH 8.3 | to pH 8.5 |
| Suds suppressor | | | | | | | | |
| Dye | 0.01 | 0.01 | 0.01 | | 0.01 | 0.01 | 0.01 | 0.0 |
| Perfume | 0.5 | 0.5 | 0.5 | 0.5 | 0.7 | 0.7 | 0.8 | 0.6 |
| Perfume MicroCapsules slurry (30% am) | 0.2 | 0.5 | 0.2 | 0.3 | 0.1 | 0.3 | 0.9 | 1.0 |
| Ethoxylated thiophene Hueing Dye | | | | | 0.002 | 0.004 | | |
| Water | balance | balance | balance | balance | balance | balance | balance | balance |

Examples 17-22

The following are granular detergent compositions produced in accordance with the invention suitable for laundering fabrics.

| | 17 | 18 | 19 | 20 | 21 | 22 |
|---|---|---|---|---|---|---|
| Linear alkylbenzenesulfonate with aliphatic carbon chain length $C_{11}$-$C_{12}$ | 15 | 12 | 20 | 10 | 12 | 13 |
| Other surfactants | 1.6 | 1.2 | 1.9 | 3.2 | 0.5 | 1.2 |
| Phosphate builder(s) | 2 | 25 | 4 | 3 | 2 | |

-continued

| | 17 | 18 | 19 | 20 | 21 | 22 |
|---|---|---|---|---|---|---|
| Zeolite | | 1 | | 1 | 4 | 1 |
| Silicate | 4 | 5 | 2 | 3 | 3 | 5 |
| Sodium Carbonate | 9 | 20 | 10 | 17 | 5 | 23 |
| Polyacrylate (MW 4500) | 1 | 0.6 | 1 | 1 | 1.5 | 1 |
| Amphiphilic alkoxylated grease cleaning polymer[3] | 0.2 | 0.1 | 0.3 | 0.4 | 0.4 | 1.0 |
| Carboxymethyl cellulose (Finnfix BDA ex CPKelco) | 1 | — | 0.3 | — | 1.1 | — |
| Xyloglucanase XYG1006* (mg aep/100 g detergent) | 1.5 | 2.4 | 1.7 | 0.9 | 5.3 | 2.3 |
| Other enzymes powders | 0.23 | 0.17 | 0.5 | 0.2 | 0.2 | 0.6 |
| Fluorescent Brightener(s) | 0.16 | 0.06 | 0.16 | 0.18 | 0.16 | 0.16 |

-continued

| | 17 | 18 | 19 | 20 | 21 | 22 |
|---|---|---|---|---|---|---|
| Diethylenetriamine pentaacetic acid or Ethylene diamine tetraacetic acid | 0.6 | | 0.6 | 0.25 | 0.6 | 0.6 |
| $MgSO_4$ | 1 | 1 | 1 | 0.5 | 1 | 1 |
| Bleach(es) and Bleach activator(s) | 6.88 | | 6.12 | 2.09 | 1.17 | 4.66 |
| Sulfate/Moisture/perfume | | | Balance to 100% | | | |

Examples 23-28

The following are granular detergent compositions produced in accordance with the invention suitable for laundering fabrics.

| | 23 | 24 | 25 | 26 | 27 | 28 |
|---|---|---|---|---|---|---|
| Linear alkylbenzene-sulfonate with aliphatic carbon chain length $C_{11}$-$C_{12}$ | 8 | 7.1 | 7 | 6.5 | 7.5 | 7.5 |
| Other surfactants | 2.95 | 5.74 | 4.18 | 6.18 | 4 | 4 |
| Layered silicate | 2.0 | — | 2.0 | — | — | — |
| Zeolite | 7 | — | 2 | — | 2 | 2 |
| Citric Acid | 3 | 5 | 3 | 4 | 2.5 | 3 |
| Sodium Carbonate | 15 | 20 | 14 | 20 | 23 | 23 |
| Silicate | 0.08 | — | 0.11 | — | — | — |
| Soil release agent | 0.75 | 0.72 | 0.71 | 0.72 | — | — |
| Acrylic Acid/ Maleic Acid Copolymer | 1.1 | 3.7 | 1.0 | 3.7 | 2.6 | 3.8 |
| Amphiphilic alkoxylated grease cleaning polymer[3] | 0.2 | 0.1 | 0.7 | 0.5 | 0.4 | 1.0 |
| Carboxymethyl cellulose (Finnfix BDA ex CPKelco) | 0.15 | — | 0.2 | — | 1 | — |
| Xyloglucanase XYG1006* (mg aep/100 g detergent) | 3.1 | 2.34 | 3.12 | 4.68 | 3.52 | 7.52 |
| Other enzyme powders | 0.65 | 0.75 | 0.7 | 0.27 | 0.47 | 0.48 |
| Bleach(es) and bleach activator(s) | 16.6 | 17.2 | 16.6 | 17.2 | 18.2 | 15.4 |
| Sulfate/Water & Miscellaneous | | | Balance to 100% | | | |

[1]Random graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units.

[2]Polyethylenimine (MW = 600) with 20 ethoxylate groups per —NH.

[3]Amphiphilic alkoxylated grease cleaning polymer is a polyethyleneimine (MW = 600) with 24 ethoxylate groups per —NH and 16 propoxylate groups per —NH

[4]Reversible Protease inhibitor of structure:

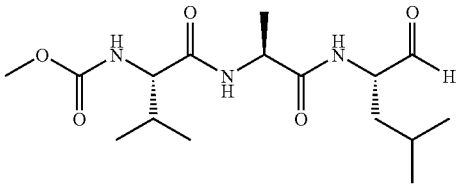

*Remark: all enzyme levels expressed as % enzyme raw material, except for xyloglucanase where the level is given in mg active enzyme protein per 100 g of detergent. XYG1006 enzyme is according to SEQ ID: 1.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm". Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

SEQUENCE LISTING

```
<160> NUMBER OF SEQ ID NOS: 1

<210> SEQ ID NO 1
<211> LENGTH: 524
<212> TYPE: PRT
<213> ORGANISM: Paenibacillus polyxyma

<400> SEQUENCE: 1

Val Val His Gly Gln Thr Ala Lys Thr Ile Thr Ile Lys Val Asp Thr
1               5                   10                  15

Phe Lys Asp Arg Lys Pro Ile Ser Pro Tyr Ile Tyr Gly Thr Asn Gln
            20                  25                  30

Asp Leu Ala Gly Asp Glu Asn Met Ala Ala Arg Arg Leu Gly Gly Asn
        35                  40                  45
```

-continued

```
Arg Met Thr Gly Tyr Asn Trp Glu Asn Asn Met Ser Asn Ala Gly Ser
    50                  55                  60

Asp Trp Gln Gln Ser Ser Asp Asn Tyr Leu Cys Ser Asn Gly Gly Leu
65                  70                  75                  80

Thr Gln Ala Glu Cys Glu Lys Pro Gly Ala Val Thr Thr Ser Phe His
                85                  90                  95

Asp Gln Ser Leu Lys Leu Gly Thr Tyr Ser Leu Val Thr Leu Pro Met
            100                 105                 110

Ala Gly Tyr Val Ala Lys Asp Gly Asn Gly Ser Val Gln Glu Ser Glu
        115                 120                 125

Lys Ala Pro Ser Ala Arg Trp Asn Gln Val Val Asn Ala Lys Asn Ala
    130                 135                 140

Pro Phe Gln Leu Gln Pro Asp Leu Asn Asp Asn Arg Val Tyr Val Asp
145                 150                 155                 160

Glu Phe Val His Phe Leu Val Asn Lys Tyr Gly Thr Ala Ser Thr Lys
                165                 170                 175

Ala Gly Val Lys Gly Tyr Ala Leu Asp Asn Glu Pro Ala Leu Trp Ser
            180                 185                 190

His Thr His Pro Arg Ile His Gly Glu Lys Val Gly Ala Lys Glu Leu
        195                 200                 205

Val Asp Arg Ser Val Ser Leu Ser Lys Ala Val Lys Ala Ile Asp Ala
    210                 215                 220

Gly Ala Glu Val Phe Gly Pro Val Leu Tyr Gly Phe Gly Ala Tyr Lys
225                 230                 235                 240

Asp Leu Gln Thr Ala Pro Asp Trp Asp Ser Val Lys Gly Asn Tyr Ser
                245                 250                 255

Trp Phe Val Asp Tyr Tyr Leu Asp Gln Met Arg Leu Ser Ser Gln Val
            260                 265                 270

Glu Gly Lys Arg Leu Leu Asp Val Phe Asp Val His Trp Tyr Pro Glu
        275                 280                 285

Ala Met Gly Gly Gly Ile Arg Ile Thr Asn Glu Val Gly Asn Asp Glu
    290                 295                 300

Thr Lys Lys Ala Arg Met Gln Ala Pro Arg Thr Leu Trp Asp Pro Thr
305                 310                 315                 320

Tyr Lys Glu Asp Ser Trp Ile Ala Gln Trp Asn Ser Glu Phe Leu Pro
                325                 330                 335

Ile Leu Pro Arg Leu Lys Gln Ser Val Asp Lys Tyr Tyr Pro Gly Thr
            340                 345                 350

Lys Leu Ala Met Thr Glu Tyr Ser Tyr Gly Gly Glu Asn Asp Ile Ser
        355                 360                 365

Gly Gly Ile Ala Met Thr Asp Val Leu Gly Ile Leu Gly Lys Asn Asp
    370                 375                 380

Val Tyr Met Ala Asn Tyr Trp Lys Leu Lys Asp Gly Val Asn Asn Tyr
385                 390                 395                 400

Val Ser Ala Ala Tyr Lys Leu Tyr Arg Asn Tyr Asp Gly Lys Asn Ser
                405                 410                 415

Thr Phe Gly Asp Thr Ser Val Ser Ala Gln Thr Ser Asp Ile Val Asn
            420                 425                 430

Ser Ser Val His Ala Ser Val Thr Asn Ala Ser Asp Lys Glu Leu His
        435                 440                 445

Leu Val Val Met Asn Lys Ser Met Asp Ser Ala Phe Asp Ala Gln Phe
    450                 455                 460

Asp Leu Ser Gly Ala Lys Thr Tyr Ile Ser Gly Lys Val Trp Gly Phe
```

-continued

```
465                 470                 475                 480

Asp Lys Asn Ser Ser Gln Ile Lys Glu Ala Ala Pro Ile Thr Gln Ile
                485                 490                 495

Ser Gly Asn Arg Phe Thr Tyr Thr Val Pro Pro Leu Thr Ala Tyr His
            500                 505                 510

Ile Val Leu Thr Thr Gly Asn Asp Thr Ser Pro Val
        515                 520
```

What is claimed is:

1. A laundry detergent composition comprising:

(i) a glycosyl hydrolase having enzymatic activity towards both xyloglucan and amorphous cellulose substrates, wherein the glycosyl hydrolase is selected from GH families 5, 12, 44 or 74; and (ii) amphiphilic alkoxylated grease cleaning polymer; and (iii) detersive surfactant.

2. A composition according to claim 1, wherein the glycosyl hydrolase enzyme belongs to glycosyl hydrolase family 44.

3. A composition according to claim 1, wherein the glycosyl hydrolase enzyme has a sequence at least 80% homologous to sequence ID No. 1.

4. A composition according to claim 1, wherein the composition is in the form of a liquid.

5. A composition according to claim 1, wherein the composition comprises a random graft co-polymer, wherein the random graft co-polymer comprises:

(i) hydrophilic backbone comprising monomers selected from the group consisting of: unsaturated $C_1$-$C_6$ carboxylic acids, ethers, alcohols, aldehydes, ketones, esters, sugar units, alkoxy units, maleic anhydride, saturated polyalcohols, and mixtures thereof; and (ii) hydrophobic side chain(s) selected from the group consisting of: $C_4$-$C_{25}$ alkyl group, polypropylene, polybutylene, vinyl ester of a saturated $C_1$-$C_6$ mono-carboxylic acid, $C_1$-$C_6$ alkyl ester of acrylic or methacrylic acid, and mixtures thereof.

6. A composition according to claim 1, wherein the composition comprises a compound having the following general structure: bis($(C_2H_5O)(C_2H_4O)n)(CH_3)$—$N^+$—$C_xH_{2x}$—$N^+$—$(CH_3)$-bis($(C_2H_5O)(C_2H_4O)n$), wherein n=from 20 to 30, and x=from 3 to 8, or sulphated or sulphonated variants thereof.

7. A composition according to claim 5, wherein the composition comprises a compound having the following general structure: bis($(C_2H_5O)(C_2H_4O)n)(CH_3)$—$N^+$—$C_xH_{2x}N^+$—$(CH_3)$-bis($(C_2H_5O)(C_2H_4O)n$), wherein n=from 20 to 30, and x=from 3 to 8, or sulphated or sulphonated variants thereof.

8. A composition according to claim 1, wherein the composition comprises from 2 wt % to 20 wt % detersive surfactant.

9. A composition according to claim 1, wherein the composition comprises at least one adjunct ingredient selected from the group consisting of: solvent and/or organic solvent; additional enzyme selected from the group consisting of amylase, protease, lipase, and mixtures thereof; protease stabilizer, structurant; brightener; soil dispersant polymer; soil removal polymer; and mixtures thereof.

10. A laundry detergent composition comprising:

(i) a glycosyl hydrolase having enzymatic activity towards both xyloglucan and amorphous cellulose substrates, wherein the glycosyl hydrolase is selected from GH families 5, 12, 44 or 74;

(ii) a random graft co-polymer comprising:

(a) hydrophilic backbone comprising monomers selected from the group consisting of: unsaturated $C_1$-$C_6$ carboxylic acids, ethers, alcohols, aldehydes, ketones, esters, sugar units, alkoxy units, maleic anhydride, saturated polyalcohols, and mixtures thereof; and (b) hydrophobic side chain(s) selected from the group consisting of: $C_4$-$C_{25}$ alkyl group, polypropylene, polybutylene, vinyl ester of a saturated $C_1$-$C_6$ mono-carboxylic acid, $C_1$-$C_6$ alkyl ester of acrylic or methacrylic acid, and mixtures thereof; and (iii) detersive surfactant.

11. A composition according to claim 10, wherein the composition is in the form of a liquid.

12. A composition according to claim 10, wherein the glycosyl hydrolase enzyme has a sequence at least 80% homologous to sequence ID No. 1.

13. A composition according to claim 10, wherein the composition comprises a compound having the following general structure: bis($(C_2H_5O)(C_2H_4O)n)(CH_3)$—$N^+$—$C_xH_{2x}$—$N^+$—$(CH_3)$-bis($(C_2H_5O)(C_2H_4O)n$), wherein n=from 20 to 30, and x=from 3 to 8, or sulphated or sulphonated variants thereof.

14. A composition according to claim 10, wherein the composition comprises from 2 wt % to 20 wt % detersive surfactant.

15. A composition according to claim 10, wherein the composition comprises at least one adjunct ingredient selected from the group consisting of: solvent and/or organic solvent; additional enzyme selected from the group consisting of amylase, protease, lipase, and mixtures thereof; protease stabilizer, structurant; brightener; soil dispersant polymer; soil removal polymer; and mixtures thereof.

16. A composition according to claim 10, wherein the composition is at least partially enclosed by a water-soluble film.

17. A composition according to claim 10, wherein the composition comprises an enzyme stabilizing agent selected from the group consisting of: calcium cations, borate, polyol solvents, and mixtures thereof.

18. A method of laundering a fabric, comprising the steps of:

(i) contacting a liquid laundry detergent composition according to claim 1 with water to form a wash liquor, (ii) contacting a fabric to the wash liquor; and (iii) optionally drying the fabric, wherein 50 g or less laundry detergent composition is dosed into the water in step (i) to form a wash liquor.

* * * * *

UNITED STATES PATENT AND TRADEMARK OFFICE

CERTIFICATE OF CORRECTION

PATENT NO. : 7,854,771 B2
APPLICATION NO. : 12/341644
DATED : December 21, 2010
INVENTOR(S) : Jean-Pol Boutique et al.

It is certified that error appears in the above-identified patent and that said Letters Patent is hereby corrected as shown below:

Column 7

Line 3, delete “algorithrn” and insert --algorithm--.

Line 19, delete “licheniformis” and insert --licheniformis--.

Column 14

Line 4, delete “where” and insert --wherein--.

Signed and Sealed this
Sixteenth Day of August, 2011

David J. Kappos

David J. Kappos
*Director of the United States Patent and Trademark Office*